US006863681B2

(12) United States Patent
Dickerson

(10) Patent No.: US 6,863,681 B2
(45) Date of Patent: Mar. 8, 2005

(54) INFANT TEETHING GEL APPLICATOR

(75) Inventor: Dan Dickerson, Louisville, KY (US)

(73) Assignee: Daniel R Dickerson, Louisville, KY (US)

( * ) Notice: Subject to any disclaimer, the term of this patent is extended or adjusted under 35 U.S.C. 154(b) by 190 days.

(21) Appl. No.: 10/176,153

(22) Filed: Jun. 20, 2002

(65) Prior Publication Data

US 2003/0236556 A1 Dec. 25, 2003

(51) Int. Cl.[7] ..... A61J 17/00

(52) U.S. Cl. ..... 606/235; 606/234; 606/236; D24/194; D24/195; D24/196

(58) Field of Search ..... 215/11.1–11.6; 604/19, 77, 310; D24/194–196, 197; 606/234, 235, 236; 128/859

(56) References Cited

U.S. PATENT DOCUMENTS 2,612,165 A * 9/1952 Szuderski ..... 606/236
3,610,248 A * 10/1971 Davidson ..... 606/236
4,192,307 A * 3/1980 Baer ..... 606/236
5,284,490 A * 2/1994 Green ..... 606/235
5,395,392 A * 3/1995 Suhonen ..... 606/234
5,766,223 A * 6/1998 Johnson ..... 606/235
6,334,231 B2 * 1/2002 Safieh ..... 15/167.1

* cited by examiner

*Primary Examiner*—Michael J. Milano
*Assistant Examiner*—Michael Mendoza
(74) *Attorney, Agent, or Firm*—Lathsop & Gage; Peter C. Knops

(57) ABSTRACT

The present invention provides an infant teething gel applicator for the application of anesthetic gel, having a teething portion to administer a regulated and minimal dosage of medication, and a collar to fit inside a standard baby bottle. The collar extends radially in a first plane and the teething portion extends laterally from the collar and is aligned longitudinally in a direction generally orthogonal to the collar. The teething portion has an outer engaging surface with a plurality of protrusions extending outward therefrom. Each individual protrusion contains a single minute pore configured to harbor medication, which is dispersed upon an infant chewing the device.

4 Claims, 4 Drawing Sheets

INFANT TEETHING GEL APPLICATOR

FIELD OF INVENTION

The present invention relates to a bottle fitted infant teething gel applicator that slowly delivers a regulated amount of medication to an infant's gums.

BACKGROUND OF THE INVENTION

The process of teething is a natural occurrence that is encountered by infants in their first two to three years of life. Through the eruption of teeth through the gums, infants often experience pain and discomfort that is typically addressed through the use of chewable objects or certain types of medications. More specifically, topical anesthetics, such as benzocaine, are often applied to areas of the infant's gums that are irritated.

The primary problem with the use of such topical anesthetics is the application of a proper dosage of the medication, over time, to areas that are specifically irritated. For example, caregivers may dispense a proscribed amount of topical anesthetic onto their finger or other object for rubbing onto the infants gums. This method is problematic for a number of reasons. First, the infant usually is too young to communicate which specific gum areas are in discomfort. Therefore, medicine is needlessly wasted by applying it over all the gum areas. Second, if a dosage of anesthetic is applied all at one time, discomfort may resume within a short period of time as the medicine wears off. As most anesthetics can only be applied so often to avoid the risk of overdosing, the caregiver may not be able to quickly reapply the anesthetic.

Thus, what is desired is an infant teething gel applicator arrangement that manages the distribution of topical anesthetics over long periods of time, so as to minimize medicinal intake; directs the infant to chew only on medicated portions of said device; improves cleanliness with minimized contact of the engaging surfaces and the floor; and allows an infant to self administer the analgesic gel to the precise areas of the gums where the pain occurs.

SUMMARY OF THE INVENTION

The present invention provides an infant teething gel applicator, comprising a resilient chewing portion and a collar. The chewing portion is an elongated structure having a proximal end attached to a hemispherically-shaped shoulder, a free distal end, and opposing outer engaging surfaces. The said chewing portion contains an array of protrusions that are each capable of entrapping analgesic gel within tiny pores located atop each protrusion. The said analgesic gel is dispersed upon an infant chewing the said protrusions. The collar has a ring-shaped base with the said hemispherically-shaped shoulder extending from the base. This arrangement allows the device to fit within a standard baby bottle for usage. With the device being attached to a baby bottle, an infant may self-administer the medication, and the potential for compromise of the device's hygiene, through the contact of the engaging surfaces and the floor, is minimized, as the bottle's larger periphery rests on the floor due to its weight, and the engaging surfaces are suspended in the air.

DETAILED DESCRIPTION OF THE INVENTION

Figure 1:
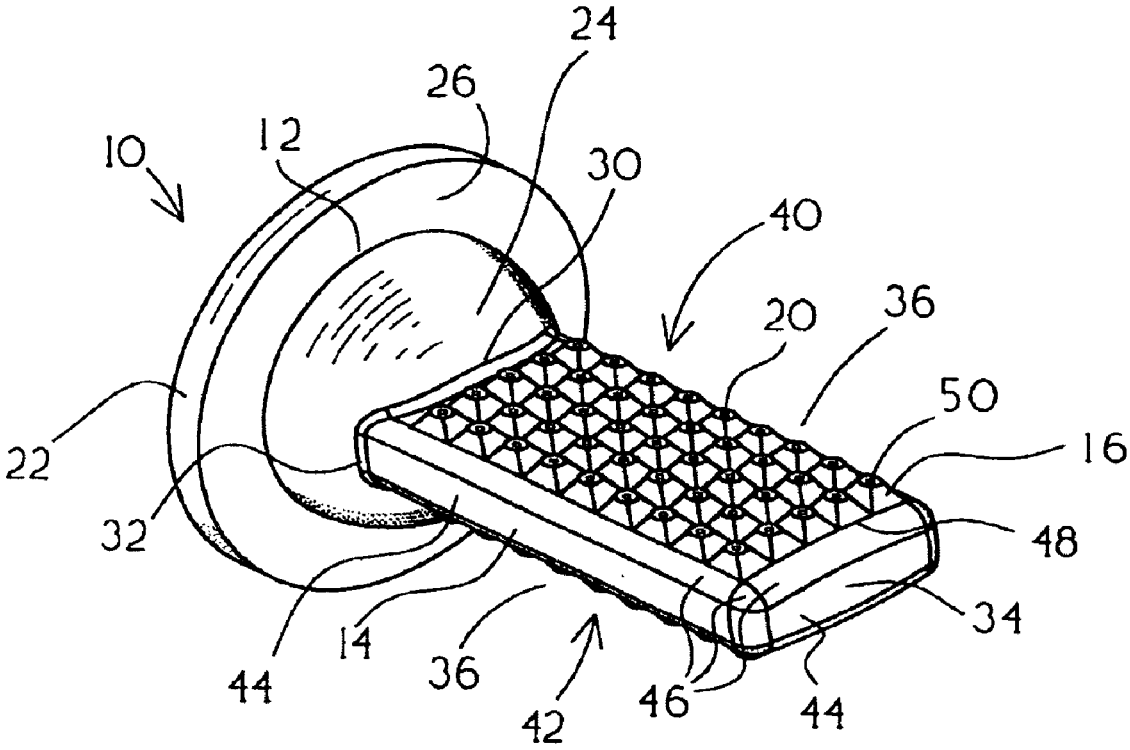
FIG. 1 is a perspective view of the infant teething gel applicator in accordance with an embodiment of the present invention.

The infant teething device of the present invention is shown generally at 10 in FIG. 1. The device 10 comprises a collar section 12 and a teething or chewing portion 14 extending from the collar and having an array of protrusions 16 that are each capable of entrapping analgesic gel within tiny pores located atop each protrusion. In this arrangement, when an infant chews on the teething portion 14 with their teeth and/or gums, such teething portion is compressed towards a conduit 18 therein, best seen in FIG. 3. This compression causes flexure in the protrusions 16, which reduces the volume of pores 20 into which topical anesthetic is placed, thereby expelling the anesthetic onto the infant's gums for relief of pain and discomfort. The infant teething gel applicator is preferably made of a compressible, rubber-like material that can be molded as a one piece unit. Such materials may include natural rubber or silicone, and should be safe enough for an infant to insert into their mouth.

Figure 3:
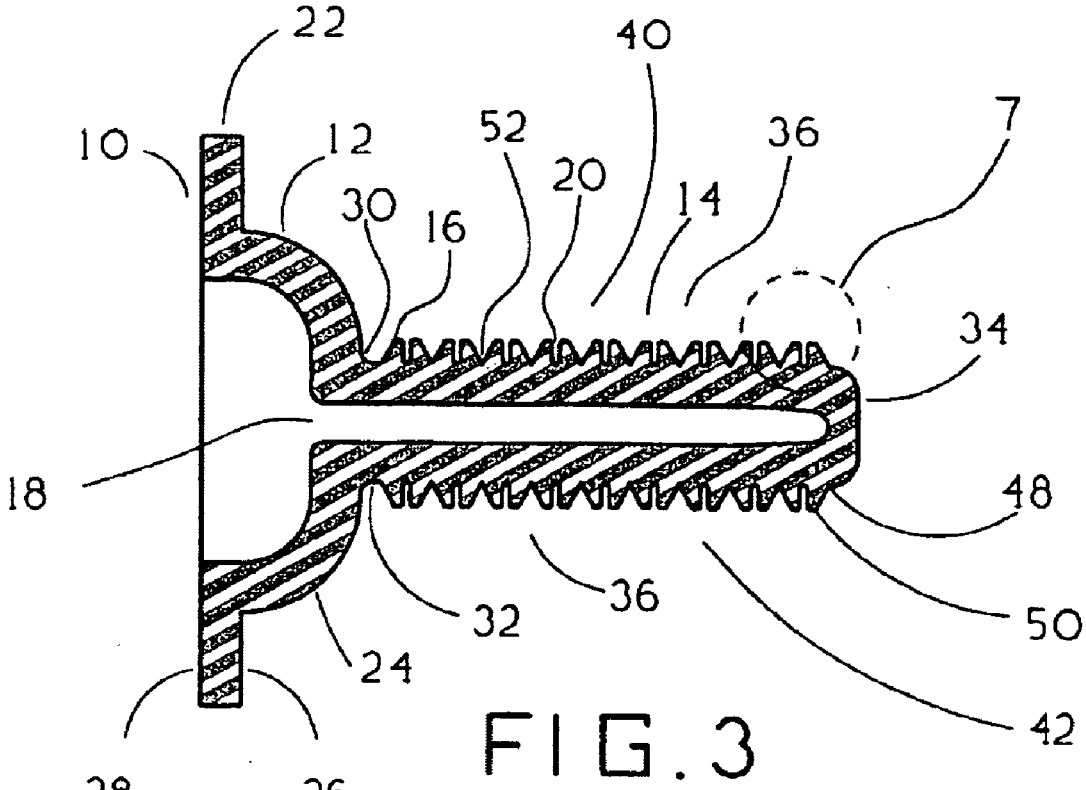
FIG. 3 is a sectional view taken along line 2—2.
Figure 2:
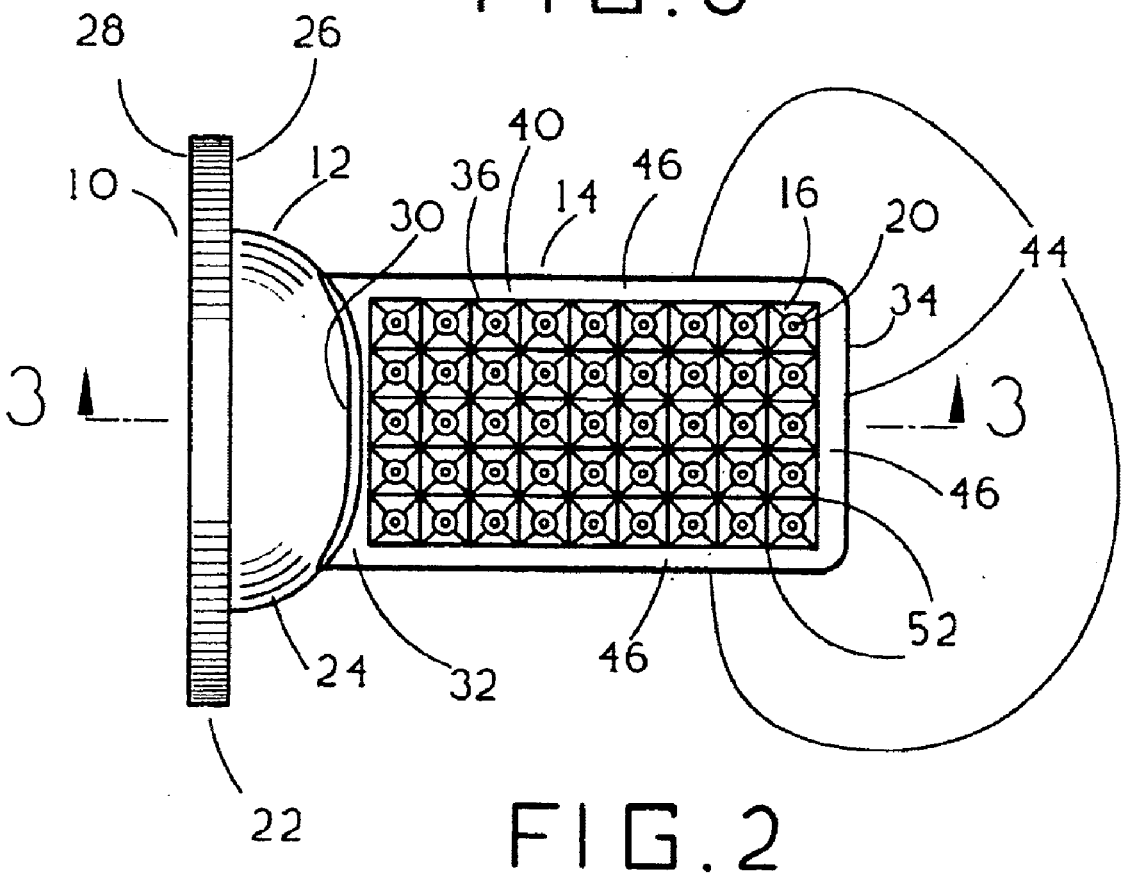
FIG. 2 is a top plan view of the infant teething gel applicator of FIG. 1.
Figure 6:
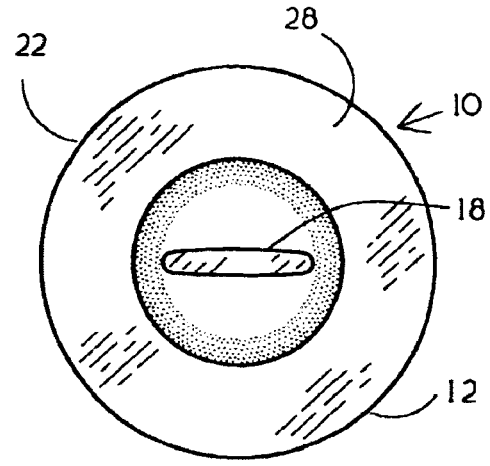
FIG. 6 is a rear elevational view of the infant teething gel applicator of FIG. 1.
Figure 4:
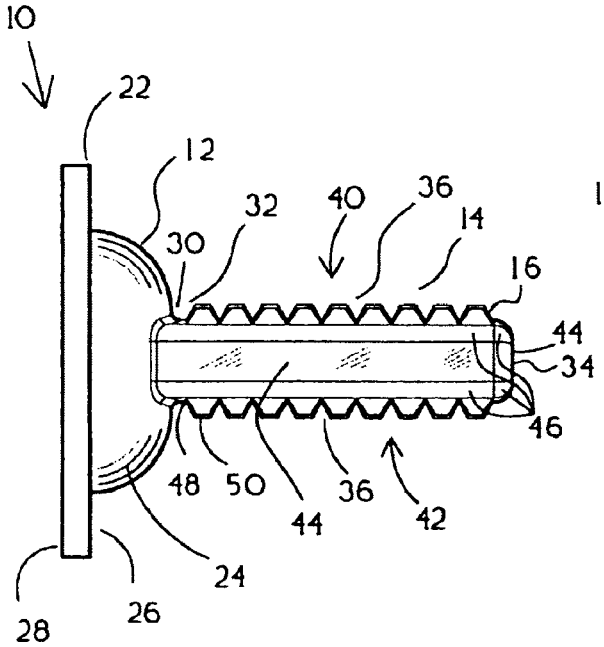
FIG. 4 is a side elevational view of the infant teething gel applicator of FIG. 1.
Figure 5:
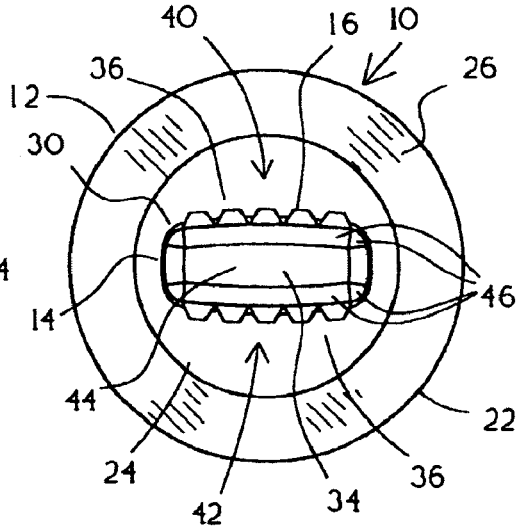
FIG. 5 is a front elevational view of the infant teething gel applicator of FIG. 1.
Figure 7:
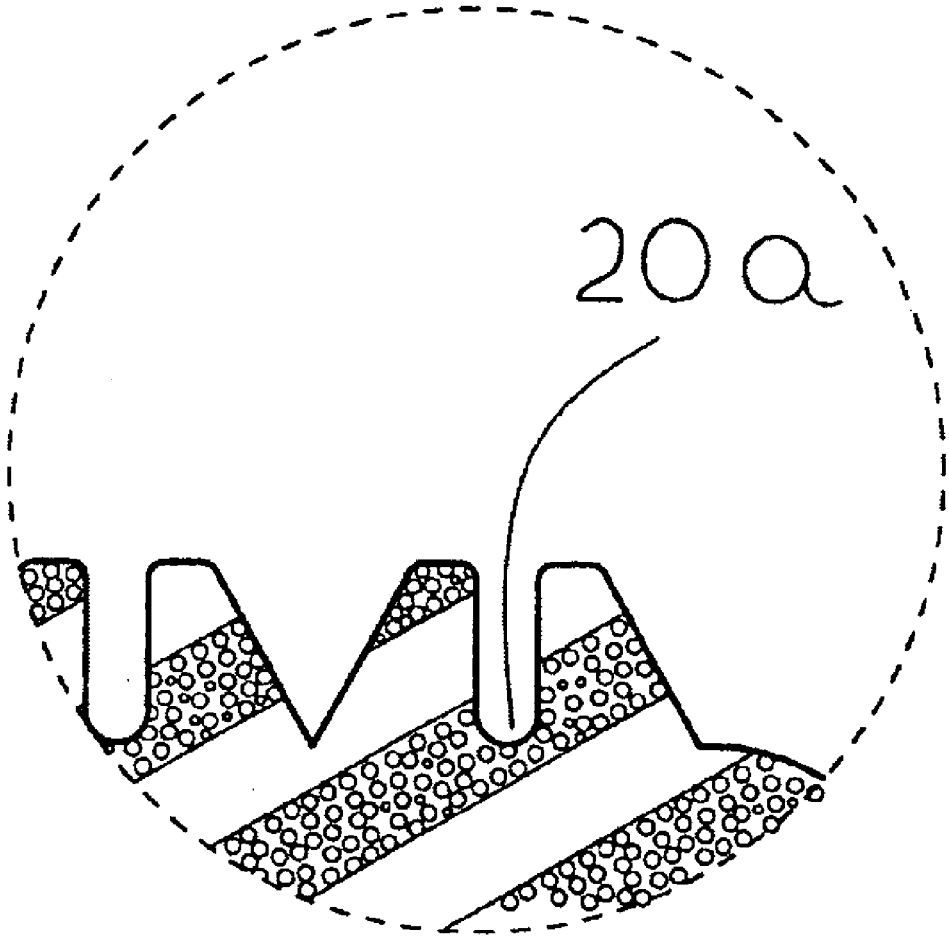
FIG. 7 is a magnified representation of the pore shape, included within the circle on FIG. 3.

The collar section 12 has a base section or guard 22 that is preferably ring-shaped and a hemispherically-shaped shoulder 24, as seen in FIGS. 1, 2 and 4. Opposing first and second planar surfaces 26, 28 are formed on guard 22 and the shoulder 24 extends from the first planar surface. FIGS. 3 and 6 show the conduit 18 formed in the collar section 12 and extending generally laterally inward from the second planar surface 28 into teething portion 14. The section of the conduit 18 within the collar section 12 preferably begins with a disk shape and transitions into a hemispherical shape to mimic the overall shape of the collar and reduce material usage during manufacturing. Preferably, the collar section 12 is sized and configured to allow the device 10 to be placed within the neck of a baby bottle for usage, with the guard 22 having a diameter of about 1{7/16} inches, so the device will fit onto standard sized baby bottles. In this way, device 10 is secured much like a standard nipple on a bottle. Also, the shoulder 24 preferably has a diameter of about {15/16} of an inch where the shoulder intersects the first planar surface 26, as seen in FIG. 5, to allow an infant to rest their lips thereon while using the teething portion 14.

The teething portion 14 extends laterally outward generally from a central region 30 of the hemispherically-shaped shoulder 24 at a proximal end 32 thereof, and terminates at a free distal end 34, as seen in FIGS. 1–4. The teething portion 14 is generally rectangular in shape, and conduit 18 extends longitudinally therethrough and terminates near distal end 34. The conduit 18 section within the teething portion 14 has a shape that generally mimics that of the teething portion, as seen in FIGS. 3 and 6. The conduit 18 should be sized such that the device 10 has the right amount of resilience for chewing by an infant to compress the teething portion 14 and distort volume of pores 20 to expel medication. An outer engaging surface 36 is provided with a plurality of protrusions 16 extending therefrom. The protrusions 16 are located on at least one of upper and lower exterior surfaces 40, 42 of the teething portion, and preferably on both surfaces such that an infant can simultaneously chew on the device 10 with both upper and lower sets of gums and/or teeth. A smooth exterior side surface 44 extends around a perimeter edge of the teething portion 14. To allow for ease in insertion of the teething portion 14 into the infant's mouth, beveled edges 46 may be provided between the exterior side surface 44 and the upper and lower exterior surfaces 40, 42 having protrusions 16. Ideally, the teething portion 14 has a length of about 1⅛ inches a width of about ¾ inches.

Each protrusion 16 extends outwardly from the outer engaging surface 36 and preferably tapers in width from a base section 48 to a tip 50. Each pore 20, preferably cylindrical in shape, is disposed within each protrusion 16 to store a proscribed amount of medication dosage. The protrusions 16 can be of a variety of shapes, such as conical, and preferably are pyramidal with a 4-sided base 48 and a sectioned flat upper surface or tip 50. In the pyramidal arrangement, the protrusions ideally have a width of about ⅛ of an inch at the base section 48, a width of about 1/16 of an inch at the tip 50, and a height of about 1/16 of an inch. This configuration allows the protrusions 16 to form a set of rows and columns defining a plurality of transverse and longitudinally aligned, interspaced grooves 52. These grooves 52 facilitate the cleaning and removal of excess topical anesthetic and other debris from the outer engaging surface 36.

Ideally, each pore 20 in a protrusion 16 has a hemispherical bottom 20*a* and is sized with a specific volume, such that the combined pore volume does not exceed the volume dosage of medication recommended for an infant's topical anesthetics, such as (0.002 cc) of 7 percent concentration of benzocaine. Thus, when medication is applied in the proper dosage to the pores 20 of the protrusions 16, and the excess is removed from the grooves 52 of the outer engaging surface 36, a small amount of the actual dosage is available for contact with the soft tissues of the mouth. The depth of the pore 20 should be at least twice but no more than 4 times as deep as the pore diameter, so as to moderate the gel dispersion rate, while not hindering the cleaning of the hemispherical bottom 20*a*. Ideally, the pore depth is about 0.05 inches and the pore diameter is about 0.02 inches, but no deeper than the protrusion tips rise above its base, as compression of the underlying mass would provoke generalized pore deformation. In an exemplary configuration, 45 pores on each surface may be used (9 rows by 5 columns of protrusions 16), but any number may be chosen so long as the total pore volume dosage for holding medication does not exceed that recommended for an infant's topical anesthetics.

Because the protrusions 16 extend outward from the outer engaging surface 36, the pores 20 are well positioned to administer medication directly onto irritated areas of the infant's gum as the device 10 is being used. The tapering of the protrusions 16 in width from the base section 48 to the tip 50 provides the protrusions with the proper amount of rigidity; the protrusions are narrow enough at the tip 50 to provide some flex for expelling medicine from the pores 20, but wide enough at the base 48 as to avoid buckling and excessive distortion by the infant's gums which would expel excessive medicine quickly. Also, the protrusions 16 are shaped to aid in the eruption of underlying teeth in the infant's gums.

By way of use, a recommended dosage of topical anesthetic is disperse from a medicine container and rubbed onto the protrusions 16 of the device 10, with a finger in a circular motion, to work the medicine into the pores 20. Because of the transverse and longitudinally aligned grooves 52, excess medication that passes into the grooves can be easily removed, for example with a cotton swab. The teething portion 14 can then be placed in an infant's mouth. As the infant uses their teeth and/or gums to compress the teething portion 14, the protrusions 16, more specifically the pores 20, are compressed laterally and vertically to reduce the pore volume and expel traces of gel to soothe areas of gum irritation. Also as a result of the chewing action by the infant, saliva will aid in lifting the deposits of gel deep inside the pores 20 to fully use up the dosage of medication.

While certain forms of the present invention have been illustrated and described herein, it is not to be limited to the specific forms or arrangement of parts described and shown.

What is claimed is:

1. An infant teething gel applicator arrangement, comprising a resilient chewing portion that is an elongated structure, which has opposing outer engaging surfaces that contain an array of protrusions, that extend outward from the said chewing portion that are each capable of entrapping a minimal amount of analgesic gel within a tiny pore located atop each protrusion and extending inward no further than the base of said protrusion; and said chewing portion having a free distal end, and a proximal end attached to a hemispherically-shaped shoulder which is attached to a collar that has a ring-shaped base, which fits within a standard baby bottle.

2. The device of claim 1, wherein said array of protrusions, each protrusion having a pyramid shape that is tapered in width extending outward from the elongated structure forming the outer engaging surfaces, forming a set of rows extending transversely across each outer engaging surface and a set of columns extending longitudinally across each outer engaging surface; the said set of rows and columns defining an array of transverse and longitudinally aligned grooves there between.

3. The device of claim 1, wherein said tiny pore in each protrusion has an aperture at the top that connects with a hemispherical bottom, such that the depth of each pore approaches, but never extends beyond the protrusion's base surface, which should be at least twice but no more than 4 times as deep as the pore diameter, and is sized with a specific volume, so that the combined pore volume of all said protrusions on the devise does not exceed the dosage of medication recommended for an infant's topical anesthetics.

4. The device of claim 1, wherein said infant teething gel applicator has a proximal end attached to a hemispherically-shaped shoulder which is attached to a collar that has a ring-shaped base, which fits within a standard baby bottle.

* * * * *